US010334886B2

(12) United States Patent
Qiu

(10) Patent No.: US 10,334,886 B2
(45) Date of Patent: Jul. 2, 2019

(54) ATOMIZER AND ELECTRONIC CIGARETTE THEREOF

(71) Applicant: CHANGZHOU PATENT ELECTRONIC TECHNOLOGY CO., LTD., Changzhou (CN)

(72) Inventor: Weihua Qiu, Changzhou (CN)

(73) Assignee: Changzhou Patent Electronic Technology Co., Ltd., Jiangsu (CN)

( * ) Notice: Subject to any disclaimer, the term of this patent is extended or adjusted under 35 U.S.C. 154(b) by 57 days.

(21) Appl. No.: 15/798,214

(22) Filed: Oct. 30, 2017

(65) Prior Publication Data

US 2018/0116289 A1 May 3, 2018

(30) Foreign Application Priority Data

Nov. 2, 2016 (CN) ..... 2016 2 1166460
Nov. 2, 2016 (CN) ..... 2016 2 1166502

(51) Int. Cl.
*A24F 47/00* (2006.01)

(52) U.S. Cl.
CPC ..... *A24F 47/008* (2013.01)

(58) Field of Classification Search
CPC ..... A24F 47/008
See application file for complete search history.

(56) References Cited

U.S. PATENT DOCUMENTS

2018/0116289 A1* 5/2018 Qiu ..... A24F 47/008
2018/0213845 A1* 8/2018 Qiu ..... H05B 3/03
2019/0029326 A1* 1/2019 Qiu ..... A24F 47/008
2019/0037920 A1* 2/2019 Qiu ..... A24F 47/008

FOREIGN PATENT DOCUMENTS

CN 206119187 U 4/2017
CN 206119188 U 4/2017

* cited by examiner

*Primary Examiner* — James Harvey
(74) *Attorney, Agent, or Firm* — J.C. Patents

(57) ABSTRACT

An atomizer includes a smoke channel, an atomizer head and a collecting container. An end of the smoke channel is in fluid communication with the atomizing head. The collecting container is detachably provided in the smoke channel, and the collecting container includes a collecting cavity and an air outlet in fluid communication with two ends of the smoke channel. The collecting cavity has a closed end near the atomizer head and an open end away from the atomizer head, and the open end of the collecting cavity is in fluid communication with a channel wall of the smoke channel located above the open end of the collecting cavity. The present disclosure further provides an electronic cigarette.

18 Claims, 5 Drawing Sheets

ATOMIZER AND ELECTRONIC CIGARETTE THEREOF

CROSS-REFERENCE TO RELATED APPLICATIONS

This application claims priority to Chinese Patent Application No. 201621166460.2, filed on Nov. 2, 2016, entitled "Atomizer and Electronic Cigarette thereof", and Chinese Patent Application No. 201621166502.2, filed on Nov. 2, 2016, entitled "Atomizer and Electronic Cigarette thereof", which are incorporated herein by reference in their entireties.

TECHNICAL FIELD

The present disclosure relates to the technical field of electronic cigarettes and, in particular, to an atomizer and an electronic cigarette thereof.

BACKGROUND

Condensation is a main reason for liquid leakage of an atomizer in a traditional electronic cigarette during use. That is, the electronic cigarette produces smoke after atomizing liquid, and when smoke with a higher temperature passes through a smoke channel with a lower temperature, due to heat transfer, a part of the smoke is quickly cooled and condensed into liquid on an inner wall of the smoke channel before flowing out of the smoke channel. The liquid adheres to the inner wall of the smoke channel and automatically flows down along the inner wall of the smoke channel under the force of gravity, thereby resulting in the liquid leakage.

SUMMARY

Based on this, it is necessary to provide an atomizer capable of collecting liquid adhered to an inner wall of a smoke channel to avoid leakage of the liquid at a bottom due to gravity.

It is also necessary to provide an electronic cigarette with an atomizer

An atomizer includes a smoke channel, an atomizer head and a collecting container. An end of the smoke channel is in fluid communication with the atomizing head, the collecting container is detachably provided in the smoke channel, and the collecting container includes a collecting cavity and an air outlet in fluid communication with two ends of the smoke channel The collecting cavity has a closed end near the atomizer head and an open end away from the atomizer head, and the open end of the collecting cavity is in fluid communication with a channel wall of the smoke channel located above the open end of the collecting cavity.

In an embodiment, the open end of the collecting cavity is in fluid communication with the channel wall of the smoke channel located above the open end of the collecting cavity in any one of the following manners: (1) the channel wall of the smoke channel located above the open end of the collecting cavity extends from the open end of the collecting cavity into the collecting cavity; (2) the channel wall of the smoke channel located above the open end of the collecting cavity is suspended over the open end of the collecting cavity; and (3) the channel wall of the smoke channel located above the open end of the collecting cavity is connected with a cavity wall of the collecting cavity.

In an embodiment, the collecting container includes a connecting portion and an enclosing portion. The enclosing portion is sheathed in the connecting portion, and the enclosing portion and the connecting portion are connected with each other at an end near the atomizer head, and are separated with each other at another end away from the atomizer head, such that an inner surface of the connecting portion and an outer surface of the enclosing portion jointly enclose a space therebetween to form the collecting cavity.

In an embodiment, the enclosing portion is formed by an edge of the connecting portion at the end near the atomizer head extending inwardly along a radial direction of the connecting portion and then extending upwardly along an axial direction of the connecting portion, and the air outlet is defined by an inner surface of the enclosing portion, or the air outlet is defined in an inner peripheral wall of the enclosing portion.

In an embodiment, the collecting container further includes a blocking portion when the air outlet is defined in the inner peripheral wall of the enclosing portion. The blocking portion is located at the end of the enclosing portion where the enclosing portion is separated from the connecting portion and isolates between above the atomizer head and another end of the smoke channel.

In an embodiment, the atomizer further includes a top cover and an atomizing sleeve. An end of the atomizing sleeve is sheathed outside the atomizer head, another end of the atomizing sleeve opposite to the atomizer head is detachably connected with the top cover, and two ends of the top cover is defined with a vent through hole extending through the two opposite ends thereof. The vent through hole and an inner cavity of the atomizing sleeve located between the atomizer head and the top cover are in fluid communication with each other to form the smoke channel.

In an embodiment, the top cover includes a body and an extending edge provided at a periphery of the body. The vent through hole is defined in the body and runs through two ends of the body positioned along its axial direction. The end of the atomizing sleeve opposite to the atomizer head is detachably connected with the extending edge. The body extends into the atomizing sleeve at an end and is detachably connected with the end of the connecting portion where the connecting portion is separated from the enclosing portion, and the vent through hole is in fluid communication with the atomizer head via the air outlet.

In an embodiment, an inner wall of the inner cavity of the atomizing sleeve and/or an inner wall of the vent through hole forming the smoke channel is coated with a coating of a low thermal conductivity material, or the atomizing sleeve and/or the top cover is made of a low thermal conductivity material.

In an embodiment, an inner wall of the inner cavity of the atomizing sleeve or an inner wall of the vent through hole is provided with a stream guiding plate protruding therefrom and inclined towards the collecting cavity; or the inner wall of the inner cavity of the atomizing sleeve or the inner wall of the vent through hole is provided with a stream guiding groove; or an inner wall of the connecting portion is formed with a stream guiding surface inclined towards the collecting cavity when the connecting portion is detachably connected with the inner wall of the inner cavity of the atomizing sleeve or the inner wall of the vent through hole.

Another atomizer includes a smoke channel, an atomizer head and a liquid absorbing element. An end of the smoke channel is in fluid communication with the atomizer head. The atomizer head is used to atomize liquid to form smoke, which, after flowing into the end of the smoke channel in fluid communication with the atomizer head, flows out from another end of the smoke channel The liquid absorbing element is made of a porous material, the liquid absorbing element is provided on a channel wall of the smoke channel, and the liquid absorbing element is used to absorb liquid generated from condensation of the smoke.

In an embodiment, the channel wall of the smoke channel protrudes inwardly to form a boss on which the liquid absorbing element is detachably supported; or the channel wall of the smoke channel is provided with a guiding groove, the liquid absorbing element protrudes peripherally to form a guiding flange which engages with the guiding groove, and the liquid absorbing element is provided on the channel wall of the smoke channel via engagement of the guiding flange and the guiding groove; or the channel wall of the smoke channel is provided with a clamp through which the liquid absorbing element is clamped with the channel wall of the smoke channel, or the liquid absorbing element is fixedly attached to the channel wall of the smoke channel.

In an embodiment, two ends of the liquid absorbing element positioned along its extending direction are run through to form an air hole between the two ends of the smoke channel.

In an embodiment, the atomizer further includes a heat insulating layer clamped between the liquid absorbing element and the channel wall of the smoke channel.

In an embodiment, at least a part of the channel wall of the smoke channel is coated with a coating of a low thermal conductivity material, or the smoke channel is at least partially made of a low thermal conductivity material.

In an embodiment, the atomizer further includes an atomizing sleeve and a top cover. The atomizing sleeve is sheathed outside the atomizer head and is connected with the top cover. Two ends of the top cover is defined with a vent through hole extending through the two opposite ends thereof. The vent through hole and an inner cavity of the atomizing sleeve located between the atomizer head and the top cover are in fluid communication with each other to form the smoke channel In an embodiment, the atomizer further includes a liquid storing sleeve which is sheathed outside the atomizing sleeve. An end of the liquid storing sleeve is connected with the atomizing sleeve, and another end of the liquid storing sleeve is connected with the top cover. A gap between the liquid storing sleeve and the atomizing sleeve forms a liquid storing cavity, and the atomizing sleeve is further provided with a liquid guiding groove in fluid communication with the atomizer head.

In an embodiment, the atomizer further includes a base assembly on which the atomizer head is detachably provided. An end of the atomizing sleeve is detachably connected with the base assembly, and another end of the atomizing sleeve opposite to the base assembly is detachably connected with the top cover.

In an embodiment, the base assembly includes a seat body and a connecting base. The connecting base is sheathed on the seat body, and an end of the connecting base away from the seat body is provided with an internal thread and an external thread on its inner surface and outer surface, respectively. The atomizer head includes an atomizer head base. An end of the atomizer head base is formed with an external thread engaged with the internal thread on the connecting base. The atomizing sleeve is sheathed outside the atomizer head base, and the end of the atomizing sleeve detachably connected with the base assembly is provided with an internal thread engaged with the external thread on the connecting base.

An electronic cigarette includes any one of the atomizers described above.

An atomizer of the present disclosure is added with a collecting container, the collecting container is provided in a smoke channel and is formed with a collecting cavity in fluid communication with a channel wall of the smoke channel, so that condensed liquid adhered to the channel wall of the smoke channel due to a long time use will automatically flow down along the channel wall of the smoke channel under the force of gravity and then flow into the collecting cavity, thereby avoiding a liquid leakage.

Another atomizer of the present disclosure is added with a liquid absorbing element, which is provided on a channel wall of a smoke channel to absorb condensed liquid adhered to the channel wall of the smoke channel due to a long time use, thereby keeping the smoke channel dry and thus solving a liquid leakage problem caused by condensation.

Figure 1:
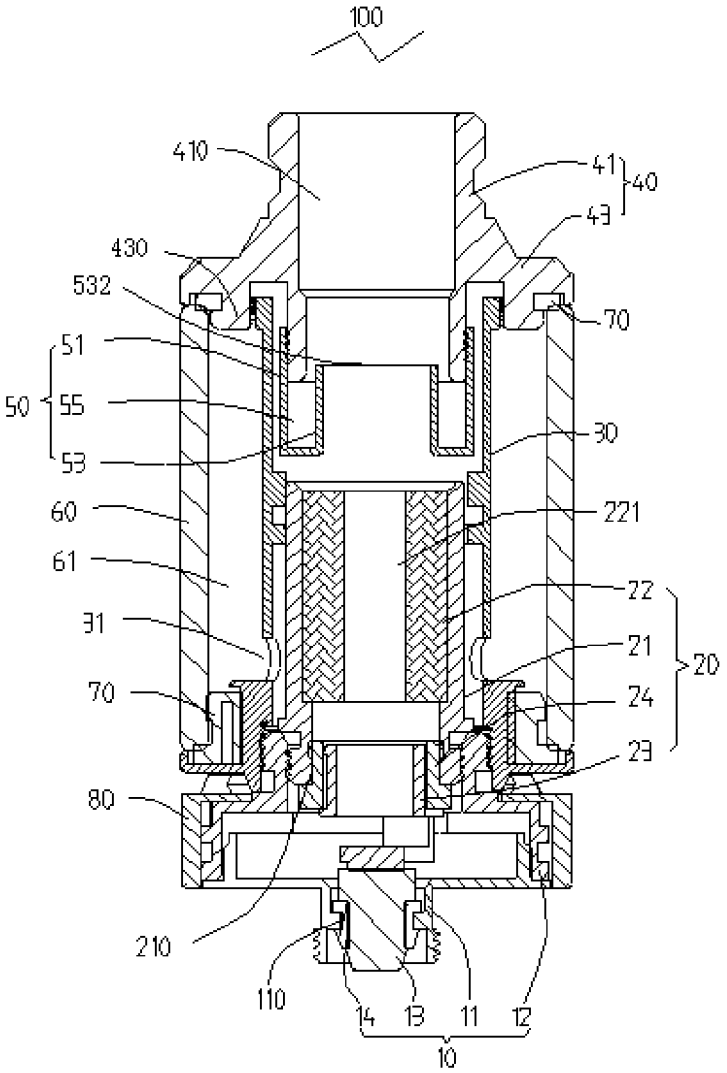
FIG. 1 is a schematic structural diagram of an atomizer (without a cigarette holder) in the first embodiment of the present disclosure.

| | |
|---|---|
| Atomizer 100, 200, 300, 400, 500 | Base assembly 10 |
| Seat body 11 | First through hole 110 |
| Connecting base 12 | First electrode 13 |
| First sealing member 14 | Atomizer head 20 |
| Atomizer head base 21 | Second through hole 210 |
| Atomizing assembly 22 | Atomizing cavity 221 |
| Second electrode 23 | Second sealing member 24 |
| Atomizing sleeve 30 | Liquid guiding groove 31 |
| Boss 33 | Heat insulating layer 35 |
| Top cover 40 | Body 41 |
| Vent through hole 410 | Extending edge 43 |
| Protruding end 430 | Collecting cavity 55 |
| Collecting container 50 | Connecting portion 51 |
| Air outlet 532 | Enclosing portion 53 |
| Blocking portion 57 | Liquid storing sleeve 60 |
| Liquid storing cavity 61 | Sealing member 70 |
| Gas regulating ring 80 | Liquid absorbing element 90 |
| Air hole 91 | Cigarette holder 600 |

DETAILED DESCRIPTION

In order to facilitate understanding of the present disclosure, the present disclosure will be described in more detail with reference to the accompanying drawings. Preferred embodiments of the present disclosure are given in the accompanying drawings. However, the present disclosure may be implemented in many different manners and is not limited to the embodiments described herein. In contrast, these embodiments are provided for the purpose of allowing the content of the present disclosure to be understood more thoroughly.

It should be noted that, when an element is referred to as being "fixed to" another element, it may be directly fixed on that element or there also may be an element located between the two elements. When an element is referred to as being "connected with" another element, it may be directly connected with that element or there also may be an element located between the two elements.

Unless otherwise defined, all technical and scientific terms used herein have the same meanings as those commonly understood by persons skilled in the art to which the present disclosure pertains. Terms used in the specification of the present disclosure are merely for the purpose of describing specific embodiments and are not intended to limit the present invention. The term "and/or" used herein includes any and all combinations of one or more related items listed.

Embodiment 1

Reference to FIG. 1, in the first embodiment of the present disclosure, an electronic cigarette includes an atomizer 100 and a battery (not shown) connected to an end of the atomizer 100. The atomizer 100 is used to atomize liquid stored therein to form smoke, and the smoke flows out via a cigarette holder (not shown) for a user to suck.

The atomizer 100 includes a base assembly 10, an atomizer head 20, an atomizing sleeve 30, a top cover 40, a collecting container 50 and a liquid storing sleeve 60. The atomizer head 20 is detachably provided on the base assembly 10. The atomizing sleeve 30 is sheathed outside the atomizer head 20 and is detachably connected with the base assembly 10 at an end. The collecting container 50 is provided in the atomizing sleeve 30 and/or the top cover 40 for collecting condensed liquid. The liquid storing sleeve 60 is sheathed outside the atomizing sleeve 30, and is connected with the end of the atomizing sleeve 30 connected with the base assembly 10 at an end. The top cover 40 is capped on another end of the liquid storing sleeve 60 opposite to the base assembly 10 and is detachably connected with another end of the atomizing sleeve 30 opposite to the base assembly 10.

Specifically, the base assembly 10 includes a seat body 11, a connecting base 12, a first electrode 13 and a first sealing member 14. The bottom of the seat body 11 is run through and provided with a first through hole 110. The first electrode 13 may be accommodated in the first through hole 110 by an interference fitting or a threaded sealing connection. Furthermore, in order to further improve sealing effects, the first sealing member 14 is provided between the first through hole 110 and the first electrode 13 when the first electrode 13 is interference fitted with the first through hole 110. It will be appreciated that the first sealing member 14 also plays a role of insulation for insulating the first electrode 13 from the seat body 11. The first sealing member 14 may be a silicone or rubber gasket.

The connecting base 12 is sheathed on the seat body 11 for supporting and connecting with the atomizing sleeve 30. An end of the connecting base 12 away from the seat body 11 is formed with an internal thread and an external thread on its inner surface and outer surface, respectively.

The atomizer head 20 includes an atomizer head base 21, an atomizing assembly 22, a second electrode 23 and a second sealing member 24. The atomizer head base 21 is generally tubular opened at two ends. One end of the atomizer head base 21 is formed with an external thread engaged with the internal thread on the connecting base 12, such that the atomizer head base 21 is detachably connected to the connecting base 12. The end of the atomizer head base 21 connected with the connecting base 12 is run through and provided with a second through hole 210. The second electrode 23 is fixed to the atomizer head base 21 through the second through hole 210 and is electrically connected with the first electrode 13. Similar to a manner in which the first through hole 110 is assembled with the first electrode 13, the second sealing member 24 is provided between the second electrode 23 and the second through hole 210 to improve sealing reliability, which prevents a user from sucking a part of liquid during suction due to the entering of excessive liquid into the atomizer head 20, thereby affecting the user's taste. In addition, the second sealing member 24 is used to insulate the second electrode 23 from the atomizer head base 21. The second sealing member 24 may be a silicone or rubber gasket.

The atomizing assembly 22 includes a liquid guiding member and a heating member. The atomizer head base 21 is run through along an axial direction to form an atomizing cavity 221, and the liquid guiding member is located in the atomizing cavity 221 to adsorb liquid. The heating member is attached to the liquid guiding member for heating the liquid absorbed by the liquid guiding member under an electric drive to form smoke for the user to suck.

Two ends of the top cover 40 is defined with a vent through hole 410 extending through the two opposite ends thereof. The vent through hole 410 and an inner cavity of the atomizing sleeving 30 located between the atomizer head 20 and the top cover 40 are in fluid communication with each other to form a smoke channel from which smoke inside the atomizer head 20 flows out. An end of the smoke channel is in fluid communication with the atomizer head 20.

Specifically, the top cover 40 includes a body 41 and an extending edge 43 provided at a periphery of the body 41. The body 41 is generally a hollow cylinder. The vent through hole 410 is defined in the body 41, runs through two ends of the body 41 positioned along an axial direction and is in fluid communication with the inner cavity of the atomizing sleeve 30.

In this particular embodiment, an end of the body 41 extends into the atomizing sleeve 30. The cigarette holder is detachably inserted into another end of the body 41 away from the atomizing sleeve 30 and is in fluid communication with the vent through hole 410. Then, a section of the atomizing sleeve 30 is spaced between a top of the atomizer head base 21 and a tip of a portion of the body 41 extending into the atomizing sleeve 30, and the smoke generated by atomizing the liquid in the atomizer head 20 enters into the cigarette holder for the user to suck after successively flowing through the section of the atomizing sleeve 30 and the vent through hole 410 under a suction action of the user. That is, the smoke channel is a flow channel through which the smoke flows during a process from flowing out of the atomizer head 20 to flowing into the user's mouth. It will be appreciated that the cigarette holder may be omitted and the user may perform suction directly through the vent through hole 410; however, when the cigarette holder is mounted, an inner cavity of the cigarette holder will become a part of the smoke channel for the smoke to flow. It will be appreciated that, in other embodiments, if other connecting pipes are provided between the atomizing sleeve 30 and the top cover 40, then the connecting pipes will also become a part of the smoke channel for the smoke to flow, and limitations are not made thereto.

A lower surface of the extending edge 43 is formed with a protruding end 430 surrounding the body 41 and protruding downwardly. A surface of the protruding end 430 facing the body 41 is formed with an internal thread. An end of the atomizing sleeve 30 is formed with an internal thread engaged with the external thread on the connecting base 12, and another end of the atomizing sleeve 30 opposite the connecting base 12 is formed with an external thread engaged with the internal thread on the protruding end 430, such that two ends of the atomizing sleeve 30 are detachably connected with the connecting base 12 and the top cover 40, respectively. It will be appreciated that, in other embodiments, the end of the atomizing sleeve 30 opposite to the connecting base 12 may be detachably connected with the tip of the body 41 directly, and limitations are not made thereto.

The collecting container 50 is detachably provided in the smoke channel, and the collecting container 50 includes a connecting portion 51 and an enclosing portion 53. The enclosing portion 53 is sheathed in the connecting portion 51, and the enclosing portion 53 and the connecting portion 5 1 are connected with each other at an end near the atomizer head 20 and separated from each other at another end away from the atomizer head 20, such that an inner surface of the connecting portion 51 and an outer surface of the enclosing portion 53 jointly enclose a space therebetween to form a collecting cavity 55 and that the collecting cavity 55 has a closed end near the atomizer head 20 and has an open end away from the atomizer head 20. The open end of the collecting cavity 55 is in fluid communication with a channel wall of the smoke channel located above it. The enclosing portion 53 is provided with an air outlet 532 which in fluid communication with two ends of the smoke channel.

As a result, during a smoking process, the smoke generated by atomizing the liquid in the atomizer head 20 flows into an end of the smoke channel and flows out from another end of the smoke channel after passing through the air outlet 532 of the enclosing portion 53. When smoke with a higher temperature passes through a smoke channel with a lower temperature, due to heat transfer, the temperature of the smoke decreases, thus the smoke is quickly cooled and condensed into small droplets on the channel wall of the smoke channel, after a long time use, the droplets are condensed into larger droplets. Since the open end of the collecting cavity 55 is in fluid communication with the channel wall of the smoke channel located above it, the condensed droplets automatically flow down along the channel wall of the smoke channel under the force of their gravities and further into the collecting cavity 55, thereby avoiding a liquid leakage phenomenon.

It will be appreciated that the open end of the collecting cavity 55 may be in fluid communication with the channel wall of the smoke channel located above it in many manners, as long as it is ensured that the condensed droplets flow into the collecting cavity 55 along the channel wall of the smoke channel In an embodiment, the channel wall of the smoke channel located above the open end of the collecting cavity 55 extends from the open end of the collecting cavity 55 into the collecting cavity 55. In another embodiment, the channel wall of the smoke channel located above the open end of the collecting cavity 55 is suspended over the open end of the collecting cavity 55. In yet another embodiment, the channel wall of the smoke channel located above the open end of the collecting cavity 55 is connected with a cavity wall of the collecting cavity 55.

In the present particular embodiment, the smoke channel includes the vent through hole 410 and the section of the atomizing sleeve 30 spaced between the top of the atomizer head base 21 and the tip of the portion of the body 41 extending into the atomizing sleeve 30. The body 41 is provided with an external thread at an outer surface of the portion extending into the atomizing sleeve 30. The end of the connecting portion 51 where the connecting portion 51 is separated from the enclosing portion 53 is sheathed outside the body 41, and is provided with an internal thread engaged with the external thread on the body 41, thereby achieving a fluid communication of the open end of the collecting cavity 55 and the channel wall of the smoke channel located above it. In this way, the collecting container 50 is detachably provided at the bottom of the top cover 40 and is located above the atomizer head 20, and thus the user may unscrew the top cover 40 in relative to the atomizing sleeve 30 and then remove the collecting container 50 from the top cover 40 to facilitate cleaning of the collecting container 50 on a regular basis (e.g., each liquid injection/suction for a certain number of times/a certain number of days).

In the present particular embodiment, the connecting portion 51 is a hollow cylinder run through at two ends, and the enclosing portion 53 is formed by an edge of the connecting portion 51 at the end near the atomizer head 20 extending inwardly along a radial direction of the connecting portion 51 and then extending upwardly along an axial direction of the connecting portion 51. Then, the connecting portion 51 and the enclosing portion 53 are connected with each other to form a collecting cavity 55 which has an open end facing the vent through hole 410 in the top cover 40 and has an accommodating function. The air outlet 532 is defined by the inner surface of the enclosing portion 53. As a result, the smoke generated by the atomizer head 20 may flow out via the air outlet 532 of the collecting container 50 and eventually flow out from the vent through hole 410 into the cigarette holder smoothly.

In the present particular embodiment, the connecting portion 51 is sheathed outside the end of the body 41 extending into the atomizing sleeve 30, and the end of the enclosing portion 53 where the enclosing portion 53 is separated from the connecting portion 51 extends into the vent through hole 410. Then, the tip of the body 41 is located above the collecting cavity 55 and is in fluid communication with the collecting cavity 55 to allow the liquid flowing down along the inner wall of the vent through hole 410 to just drop into the collecting cavity 55.

It will be appreciated that, in other embodiments, a shape and a mounting position of the collecting container 50 may be determined as required, as long as it can achieve a collection of the liquid condensed on the channel wall of the smoke channel, for instance, the collecting container 50 may be provided on an inner wall of the inner cavity of the atomizing sleeve 30 and they are detachably connected in a snap fitting manner, or the enclosing portion 53 may be provided, at the end of the enclosing portion 53 where the enclosing portion 53 is separated from the connecting portion 51, as an inverted funnel with a tapered shape serving to guide the smoke to flow out, and limitations are not made thereto.

Furthermore, for a purpose of liquid guiding during the flowing of the liquid into the collecting cavity 55, the inner wall of the inner cavity of the atomizing sleeve 30 or an inner wall of the vent through hole 410 is provided with a stream guiding plate protruding therefrom and inclined towards the collecting cavity 55; or the inner wall of the inner cavity of the atomizing sleeving 30 or the inner wall of the vent through hole 410 is provided with a stream guiding groove directly; or an inner wall of the connecting portion 51 is directly formed with a stream guiding surface inclined towards the collecting cavity 55 when the connecting portion 51 is detachably connected with the inner wall of the inner cavity of the atomizing sleeve 30 or the inner wall of the vent through hole 410.

The liquid storing sleeve 60 is tubular opened at two ends and sheathed outside the atomizing sleeve 30. An end of the liquid storing sleeve 60 is connected with the atomizing sleeve 30, and another end of the liquid storing sleeve 60 is connected with the top cover 40. Then, a gap between the liquid storing sleeve 60 and the atomizing sleeve 30 forms a liquid storing cavity 61 storing liquid. Correspondingly, the atomizing sleeve 30 is also provided with a liquid guiding groove 31 in fluid communication with the liquid guiding member and the liquid storing cavity 61, so that the liquid may be absorbed by the liquid guiding member via the liquid guiding groove 31 for the heating member to heat and atomize liquid under an electric drive.

Furthermore, in order to enhance air tightness among the liquid storing sleeve 60, the top cover 40 and the atomizing sleeve 30, the atomizer 100 further includes a sealing member 70 provided between the liquid storing sleeve 60 and the top cover 40 and between the liquid storing sleeve 60 and the atomizing sleeve 30.

Furthermore, the base assembly 10 is provided with an air inlet (not shown) in fluid communication with the atomizer head 20. The atomizer 100 further includes an air regulating ring 80, which is rotatably sheathed outside the base assembly 10 and is provided with an air regulating hole (not shown) which may be in fluid communication with or disconnection from the air inlet. During use, when the air regulating ring 80 is rotated to allow the air regulating hole to be in fluid communication with the air inlet, a certain gap is reserved between the air regulating hole and the air inlet. Outside air is mixed with the smoke in the atomizing cavity 221 thoroughly after entering into the atomizer head 20 via the gap between the air regulating hole and the air inlet, and the mixture of the outside air and the smoke flows out via the smoke channel and into the user's mouth with a suction action of the user. When the air regulating ring 80 is rotated to allow the air regulating hole to be disconnected from the air inlet, the gap between the air regulating hole and the air inlet is closed to prevent the outside air from entering.

Embodiment 2

Figure 2:
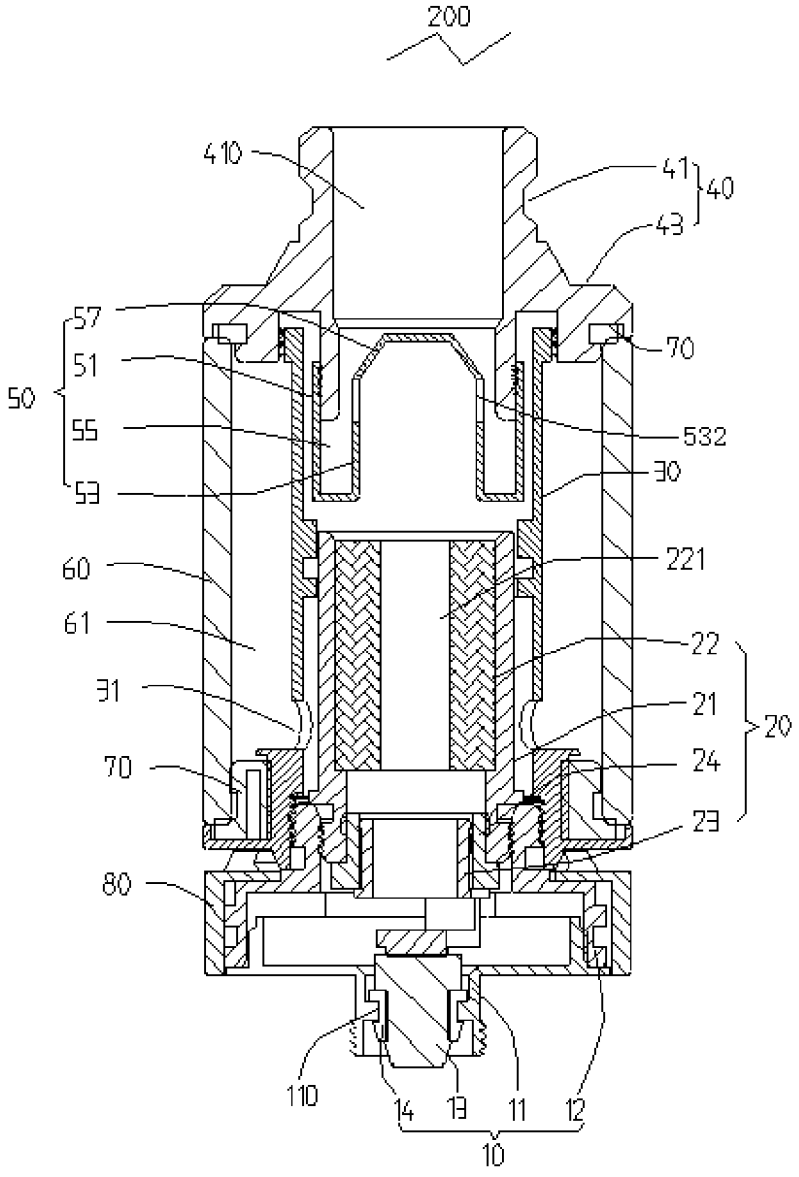
FIG. 2 is a schematic structural diagram of an atomizer (without a cigarette holder) in the second embodiment of the present disclosure.

Reference to FIG. 2, the second embodiment of the present disclosure differs from the first embodiment in that: a blocking portion 57 is added in a collecting container 50 of an atomizer 200, and the blocking portion 57 is located at an end of an enclosing portion 53 where the enclosing portion 53 is separated from a connecting portion 51 and isolates between above an atomizer head 20 and a vent through hole 410, so as to prevent liquid from getting a rapid rise in temperature to cause a high local temperature, and is sucked into a smoker's mouth to scald the smoker when the liquid is unevenly heated, or to prevent a frying oil phenomenon during insufficient atomization of the liquid due to a low atomization temperature. In the present particular embodiment, an air outlet 532 of the enclosing portion 53 is defined in an inner peripheral wall of the enclosing portion 53, such that the smoke entering a space enclosed by the inner wall of the enclosing portion 53 flows out through the air outlet 532 at the periphery.

Furthermore, in the first and second embodiments, an inner wall of the inner cavity of the atomizing sleeve 30 and/or an inner wall of the vent through hole 410 forming the smoke channel is coated with a coating of a low thermal conductivity material, or the atomizing sleeve 30 and/or the top cover 40 is made of a low thermal conductivity material. Because a low thermal conductivity material has a slow heat absorbing speed, the smoke will not be quickly cooled and condensed into liquid in the smoke channel, or it is sucked into the smoker's mouth before being condensed into the liquid, the liquid is prevented from being sucked into the smoker's mouth, and user experience is improved.

In the first and second embodiments, the collecting container 50 is added to the atomizer 100. The collecting container 50 is provided in the smoke channel and is formed with the collecting cavity 55 in fluid communication with the inner wall of the inner cavity of the atomizing sleeve 30 in the smoke channel or the inner wall of the vent through hole 410, thus the condensed liquid attached to the inner wall of the smoke channel due to a long time use will automatically flow down along the inner wall of the inner cavity of the atomizing sleeve 30 or the inner wall of the vent through hole 410 and then flow into the collecting cavity 55, thereby avoiding a liquid leakage.

Embodiment 3

Figure 3:
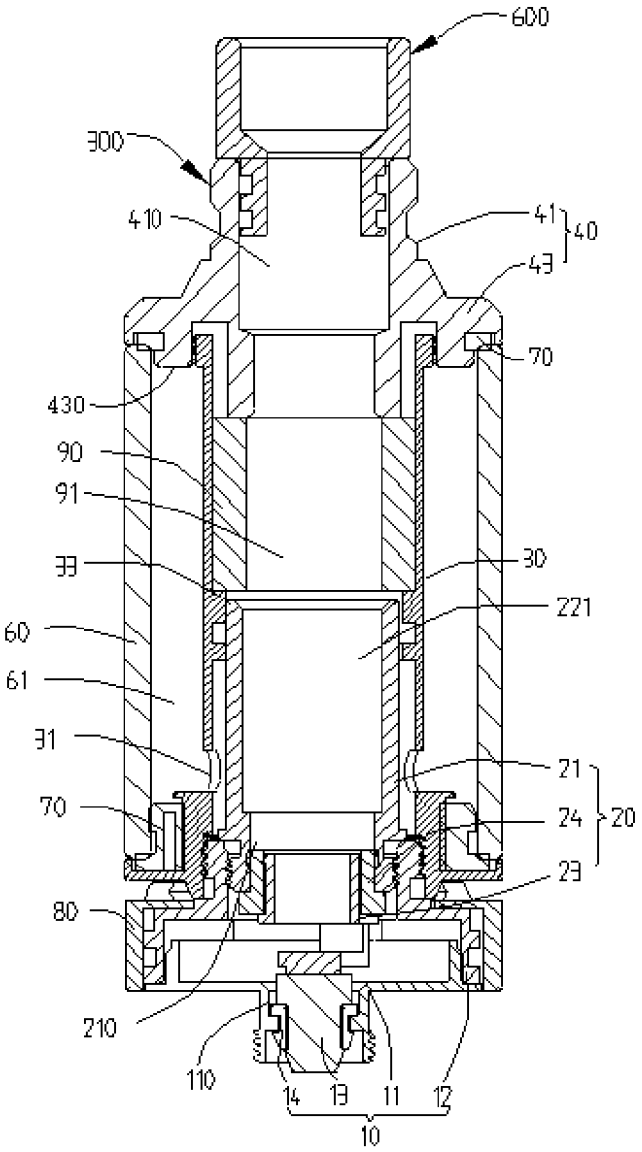
FIG. 3 is a schematic structural diagram of an atomizer in the third embodiment of the present disclosure.

Reference to FIG. 3, in the third embodiment of the present disclosure, the electronic cigarette includes an atomizer 300 and a battery (not shown) connected with an end of the atomizer 300. The atomizer 300 includes a cigarette holder 600 which is provided at an end of the atomizer 300 opposite to the battery. The atomizer 300 is used to atomize liquid stored therein to form smoke, and the smoke flows out via the cigarette holder 600 for a user to suck.

The atomizer 300 also includes a base assembly 10, an atomizer head 20, an atomizing sleeve 30, a top cover 40, a liquid absorbing element 90 and a liquid storing sleeve 60. The atomizer head 20 is detachably provided on the base assembly 10. The atomizing sleeve 30 is sheathed outside the atomizer head 20 and is detachably connected with the base assembly 10 at an end. The liquid absorbing element 90 is provided in the atomizing sleeve 30 and/or the top cover 40, which is used to absorb condensed liquid. The liquid storing sleeve 60 is sheathed outside the atomizing sleeve 30 and is connected with the atomizing sleeve 30 at an end. The top cover 40 is capped on another end of the liquid storing sleeve 60 opposite to the base assembly 10 and is detachably connected with another end of the atomizing sleeve 30 opposite to the base assembly 10.

Specifically, the base assembly 10 includes a seat body 11, a connecting base 12, a first electrode 13 and a first sealing member 14. The bottom of the seat body 11 is run through and provided with a first through hole 110. The first electrode 13 may be accommodated in the first through hole 110 by an interference fitting or a threaded sealing connection. Furthermore, in order to further improve sealing effects, the first sealing member 14 is provided between the first through hole 110 and the first electrode 13 when the first electrode 13 is interference fitted with the first through hole 110. It will be appreciated that the first sealing member 14 also plays a role of insulation for insulating the first electrode 13 from the seat body 11. The first sealing member 14 may be a silicone or rubber gasket.

The connecting base 12 is sheathed on the seat body 11 for connecting with and supporting the atomizing sleeve 30. An end of the connecting base 12 away from the seat body 11 is formed with an internal thread and an external thread on its inner surface and outer surface, respectively.

The atomizer head 20 includes an atomizer head base 21, an atomizing assembly (not shown), a second electrode 23 and a second sealing member 24. The atomizer head base 21 is generally tubular opened at two ends. One end of the atomizer head base 21 is formed with an external thread engaged with the internal thread on the connecting base 12, such that the atomizer head base 21 is detachably connected with the connecting base 12. The end of the atomizer head base 21 connected with the connecting base 12 is run through and provided with a second through hole 210. The second electrode 23 is fixed to the atomizer head base 21 through the second through hole 210 and is electrically connected with the first electrode 13. Similar to a manner in which the first through hole 110 is assembled with the first electrode 13, the second sealing member 24 is provided between the second electrode 23 and the second through hole 210 to improve sealing reliability, which prevents a user from sucking a part of liquid during suction due to the entering of excessive liquid into the atomizer head 20, thereby affecting the user's taste. In addition, the second sealing member 24 is used to insulate the second electrode 23 from the atomizer head base 21. The second sealing member 24 may be a silicone or rubber gasket.

The atomizing assembly 22 includes a liquid guiding member (not shown) and a heating member (not shown). The atomizer head base 21 is run through along its axial direction to form an atomizing cavity 221, and the liquid guiding member is provided in the atomizing cavity 221 to adsorb liquid. The heating member is attached to the liquid guiding member for heating the liquid absorbed by the liquid guiding member under an electric drive to form smoke for the user to suck.

Two ends of the top cover 40 is defined with a vent through hole 410 extending through the two opposite ends thereof. The vent through hole 410 and an inner cavity of the atomizing sleeve 30 located between the atomizer head 20 and the top cover 40 are in fluid communication with each other to form a smoke channel from which smoke inside the atomizer head 20 flows out.

Specifically, the top cover 40 includes a body 41 and an extending edge 43 provided at a periphery of the body 41. The body 41 is generally a hollow cylinder. The vent through hole 410 is defined in the body 41, runs through two ends of the body 41 positioned along an axial direction and is in fluid communication with the inner cavity of the atomizing sleeve 30. A lower surface of the extending edge 43 is formed with a protruding end 430 surrounding the body 41 and protruding downwardly. A surface of the protruding end 430 facing the body 41 is formed with an internal thread. An end of the atomizing sleeve 30 is formed with an internal thread engaged with the external thread on the connecting base 12, and another end of the atomizing sleeve 30 opposite to the connecting base 12 is formed with an external thread engaged with the internal thread on the extending edge 43, such that two ends of the atomizing sleeve 30 are detachably connected with the connecting base 12 and the top cover 40, respectively. It will be appreciated that, in other embodiments, the end of the atomizing sleeve 30 opposite to the connecting base 12 may be detachably connected with the tip of the body 41 directly, and limitations are not made thereto.

In this particular embodiment, an end of the body 41 extends into the atomizing sleeve 30. The cigarette holder 600 is detachably inserted into another end of the body 41 away from the atomizing sleeve 30 and is in fluid communication with the vent through hole 410. Then, a section of the atomizing sleeve 30 is spaced between a top of the atomizer head base 21 and a tip of a portion of the body 41 extending into the atomizing sleeve 30, and the smoke generated by atomizing the liquid in the atomizer head 20 enters into the cigarette holder 600 for the user to suck after successively flowing through the section of the atomizing sleeve 30 and the vent through hole 410 under a suction action of the user. That is, the smoke channel is a flow channel through which the smoke flows during a process from flowing out of the atomizer head 20 to flowing into the user's mouth. It will be appreciated that the cigarette holder 600 may be omitted and the user may perform suction directly through the vent through hole 410; however, when the cigarette holder 600 is mounted, an inner cavity of the cigarette holder 600 will become a part of the smoke channel for the smoke to flow. It will be appreciated that, in other embodiments, if other connecting pipes are provided between the atomizing sleeve 30 and the top cover 40, then the connecting pipes will also become a part of the smoke channel for the smoke to flow, and limitations are not made thereto.

The liquid absorbing element 90 is provided on a channel wall of the smoke channel. Specifically, the channel wall of the smoke channel protrudes inwardly to form a boss 33 on which the liquid absorbing element 90 is detachably supported.

In the third embodiment of the present disclosure, as shown in FIG. 3, the liquid absorbing element 90 is provided on an inner wall of the inner cavity of the atomizing sleeve 30 in the smoke channel and is supported on the boss 33 in the atomizing sleeve 30, and at the same time abuts against the tip of the body 41 extending into the atomizing sleeve 30.

Embodiment 4

Figure 4:
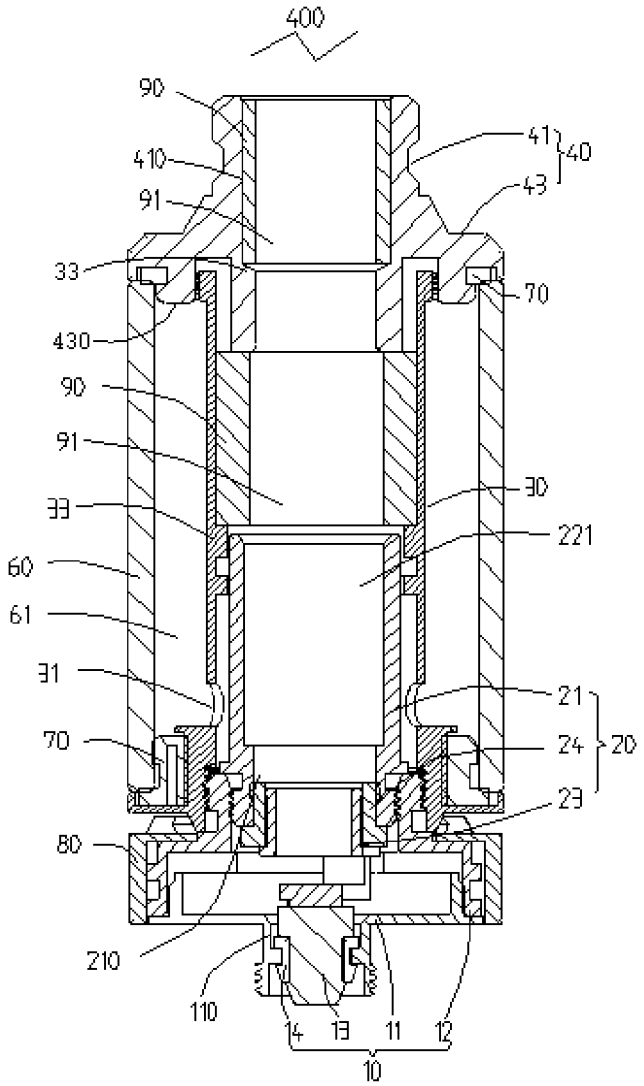
FIG. 4 is a schematic structural diagram of an atomizer (without a cigarette holder) in the fourth embodiment of the present disclosure.

Reference to FIG. 4, the fourth embodiment of the present disclosure differs from the third embodiment in that, a liquid absorbing element 90 of an atomizer 400 is provided on both an inner wall of an inner cavity of an atomizing sleeve 30 and an inner wall of a vent through hole 410 in a smoke channel, and is correspondingly supported on bosses 33 in the atomizing sleeve 30 and the vent through hole 410, respectively.

Embodiment 5

Figure 5:
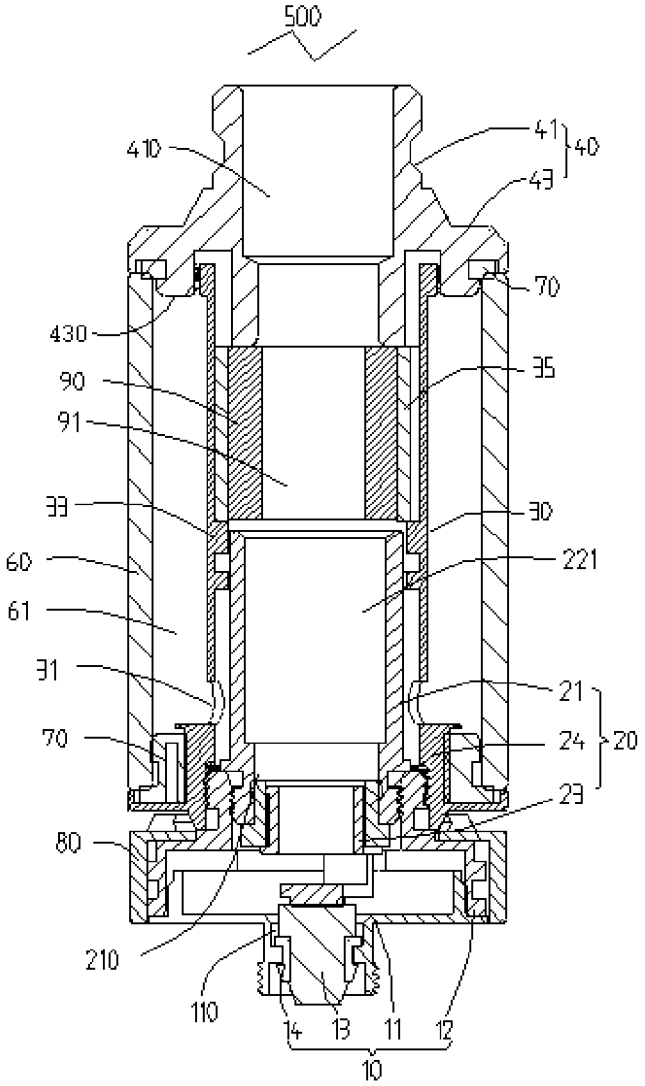
FIG. 5 is a schematic structural diagram of an atomizer (without a cigarette holder) in the fifth embodiment of the present disclosure.

Reference to FIG. 5, the fifth embodiment of the present disclosure differs from the third embodiment in that, an atomizer 500 is added with a heat insulating layer 35, and the heat insulating layer 35 and a liquid absorbing element 90 are sequentially provided on an inner wall of an inner cavity of an atomizing sleeve 30 in a smoke channel In particular, the heat insulating layer 35 is clamped between the liquid absorbing element 90 and the inner wall of the inner cavity of the atomizing sleeve 30, which thus is advantageous to prevent heat in the atomizing sleeve 30 from escaping, that is, to prevent the smoke channel from getting a rapid decrease in temperature to cause smoke to be rapidly cooled and condensed into liquid on the inner wall of the inner cavity of the atomizing sleeve 30 before flowing out of the smoke channel.

In the third to fifth embodiments described above, the liquid absorbing element 90 is made of a porous material such as a superabsorbent resin/sponge/cotton/paper/porous ceramic or other porous materials. The liquid absorbing element 90 is cylinder-shaped, and two ends of the liquid absorbing element 90positioned along its extending direction are run through to form an air hole 91in fluid communication with the two ends of the smoke channel, then, the liquid absorbing element 90 is a hollow cylindrical liquid absorbing ring which matches with the atomizing sleeve 30 and the vent through hole 410 in shape. It will be appreciated that, in other embodiments, the liquid absorbing element 90 may have a shape as required, which is not limited herein; as long as it can ensure that the smoke can flow out from the smoke channel smoothly. In addition, positions where the liquid absorbing element 90 and the heat insulating layer 35 are provided may be determined as required, for embodiment, both of them may be provided on an inner wall of the vent through hole 410.

In addition, a manner in which the liquid absorbing element 90 is provided on the channel wall of the smoke channel may also be determined as required, for example, the channel wall of the smoke channel may be provided with a guiding groove, the liquid absorbing element 90protrudes peripherally to form a guiding flange which engages with the guiding groove, and the liquid absorbing element 90 is provided on the channel wall of the smoke channel via the engagement of the guiding flange and the guiding groove; or the channel wall of the smoke channel may be provided with a clamp through which the liquid absorbing element 90 is clamped to the channel wall of the smoke channel, limitations are not made thereto, as long as it can achieve a detachable arrangement of the liquid absorbing element 90, such that a user may replace it regularly. Or even, the liquid absorbing element 90may be fixedly provided on the channel wall of the smoke channel, such that the liquid absorbing element 90 may be replaced together with the entire smoke channel. Alternatively, the liquid absorbing element 90 is fixedly disposed on a detachable portion of the smoke channel, such that only the liquid absorbing element 90 and the detachable portion are needed to be replaced, for instance, the liquid absorbing element 90 is fixedly attached to an inner wall of the inner cavity of the atomizing sleeve 30 and/or an inner wall of the vent through hole 410 directly, and the entire atomizing sleeve 30 and/or the top cover 40 are directly replaced after a certain time use. It will be appreciated that, it is difficult for the user to insert the liquid absorbing element 90 into the smoke channel, especially when it is made of a flexible material, and replacement of the liquid absorbing element 90 together with the detachable portion may facilitate the user's operation.

Furthermore, in the third to fifth embodiments described above, an inner wall of the inner cavity of the atomizing sleeve 30 and/or an inner wall of the vent through hole 410 forming the smoke channel is coated with a coating of a low thermal conductivity material, or the atomizing sleeve 30 and the top cover 40 is made of a low thermal conductivity material. Because a low thermal conductivity material has a slow heat absorbing speed, the smoke will not be quickly cooled and condensed into liquid in the smoke channel, or it is sucked into the smoker's mouth before being condensed into the liquid, the liquid is prevented from being sucked into the smoker's mouth, and user experience is improved.

The liquid storing sleeve 60 is tubular opened at two ends and sheathed outside the atomizing sleeve 30. An end of the liquid storing sleeve 60 is connected with the atomizing sleeve 30, and another end of the liquid storing sleeve 60 is connected with the top cover 40. Then, a gap between the liquid storing sleeve 60 and the atomizing sleeve 30 forms a liquid storing cavity 61 storing liquid. Correspondingly, the atomizing sleeve 30 is also provided with a liquid guiding groove 31 in fluid communication with the liquid guiding member and the liquid storing cavity 61, so that the liquid may be absorbed by the liquid guiding member via the liquid guiding groove 31for the heating member to heat and atomize under an electric drive.

Furthermore, in order to enhance air tightness among the liquid storing sleeve 60, the top cover 40 and the atomizing sleeve 30, the atomizers 300-500 further include a sealing member 70 provided between the liquid storing sleeve 60 and the top cover 40 and between the liquid storing sleeve 60 and the atomizing sleeve 30.

Furthermore, the base assembly 10 is provided with an air inlet (not shown) in fluid communication with the atomizer head 20. The atomizers 300-500 further include an air regulating ring 80,and the air regulating ring 80 is rotatably sheathed outside the base assembly 10 and is provided with an air regulating hole (not shown) which may be in fluid communication with or disconnection from the air inlet. During use, when the air regulating ring 80 is rotated to allow the air regulating hole to be in fluid communication with the air inlet, a certain gap is reserved between the air regulating hole and the air inlet. Outside air is mixed with the smoke in the atomizing cavity 221 thoroughly after entering into the atomizer head 20 via the gap between the air regulating hole and the air inlet, and the mixture of the outside air and the smoke flows out via the smoke channel and into the user's mouth with a suction action of the user. When the air regulating ring 80 is rotated to allow the air regulating hole to be disconnected from the air inlet, the gap between the air regulating hole and the air inlet is closed to prevent the outside air from entering.

In the third to fifth embodiments, by providing the liquid absorbing element 90, during a smoking process, when smoke with a higher temperature passes through a smoke channel with a lower temperature, due to heat transfer, smoke will be rapidly cooled and condensed into liquid on a channel wall before flowing out from the smoke channel, on one hand, after a long time use, the condensed liquid will automatically flow down along the channel wall of the smoke channel under the force of its gravity, and the liquid flowing down will be absorbed by the liquid absorbing element 90; on the other hand, during suction, the condensed liquid will flow upwardly along the channel wall of the smoke channel under a suction action of the user and will be absorbed by the liquid absorbing element 90 during their encountering, so as to maintain the smoke channel dry, which solves the liquid leakage problem caused by condensation, and further prevents the smoke liquid from being sucked into the user's mouth.

The above embodiments only show several implementations of the present utility mode. Although the descriptions to these embodiments are relatively specific and detailed, they may not be construed as limiting the scope of the present disclosure. It should be noted that, various modifications and improvements can be made by those skilled in the art without departing from the spirit of the present disclosure, and all of them fall into the scope of the present disclosure. Therefore, the protection scope of the present disclosure should be subject to the appended claims.

What is claimed is:

1. An atomizer, comprising: a smoke channel, an atomizer head and a collecting container, wherein an end of the smoke channel is in fluid communication with the atomizer head, the collecting container is detachably provided in the smoke channel, and the collecting container comprises a collecting cavity and an air outlet in fluid communication with two ends of the smoke channel; the collecting cavity has a closed end near the atomizer head and an open end away from the atomizer head, and the open end of the collecting cavity is in fluid communication with a channel wall of the smoke channel located above the open end of the collecting cavity.

2. The atomizer according to claim 1, wherein the open end of the collecting cavity is in fluid communication with the channel wall of the smoke channel located above the open end of the collecting cavity in any one of the following manners: (1) the channel wall of the smoke channel located above the open end of the collecting cavity extends from the open end of the collecting cavity into the collecting cavity; (2) the channel wall of the smoke channel located above the open end of the collecting cavity is suspended over the open end of the collecting cavity; and (3) the channel wall of the smoke channel located above the open end of the collecting cavity is connected with a cavity wall of the collecting cavity.

3. The atomizer according to claim 1, wherein the collecting container comprises a connecting portion and an enclosing portion; the enclosing portion is sheathed in the connecting portion, and the enclosing portion and the connecting portion are connected with each other at an end near the atomizer head, and are separated with each other at another end away from the atomizer head, such that an inner surface of the connecting portion and an outer surface of the enclosing portion jointly enclose a space therebetween to form the collecting cavity.

4. The atomizer according to claim 3, wherein the enclosing portion is formed by an edge of the connecting portion at the end near the atomizer head extending inwardly along a radial direction of the connecting portion and then extending upwardly along an axial direction of the connecting portion, and the air outlet is defined by an inner surface of the enclosing portion, or the air outlet is defined in an inner peripheral wall of the enclosing portion.

5. The atomizer according to claim 4, wherein the collecting container further comprises a blocking portion when the air outlet is defined in the inner peripheral wall of the enclosing portion; the blocking portion is provided at the end of the enclosing portion where the enclosing portion is separated from the connecting portion and isolates between above the atomizer head and another end of the smoke channel.

6. The atomizer according to claim 4, wherein the atomizer further comprises a top cover and an atomizing sleeve; an end of the atomizing sleeve is sheathed outside the atomizer head, another end of the atomizing sleeve opposite to the atomizer head is detachably connected with the top cover, and two ends of the top cover is defined with a vent through hole extending through the two opposite ends thereof, the vent through hole and an inner cavity of the atomizing sleeve located between the atomizer head and the top cover are in fluid communication with each other to form the smoke channel.

7. The atomizer according to claim 6, wherein the top cover comprises a body and an extending edge provided at a periphery of the body, the vent through hole is defined in the body and runs through two ends of the body positioned along its axial direction, the end of the atomizing sleeve opposite to the atomizer head is detachably connected with the extending edge, an end of the body extends into the atomizing sleeve and is detachably connected with the end of the connecting portion where the connecting portion is separated from the enclosing portion, and the vent through hole is in fluid communication with the atomizer head via the air outlet.

8. The atomizer according to claim 6, wherein an inner wall of the inner cavity of the atomizing sleeve and/or an inner wall of the vent through hole forming the smoke channel is coated with a coating of a low thermal conductivity material, or the atomizing sleeve and/or the top cover is made of a low thermal conductivity material.

9. The atomizer according to claim 6, wherein an inner wall of the inner cavity of the atomizing sleeve or an inner wall of the vent through hole is provided with a stream guiding plate protruding therefrom and inclined towards the collecting cavity; or the inner wall of the inner cavity of the atomizing sleeve or the inner wall of the vent through hole is provided with a stream guiding groove; or an inner wall of the connecting portion is formed with a stream guiding surface inclined towards the collecting cavity when the connecting portion is detachably connected with the inner wall of the inner cavity of the atomizing sleeve or the inner wall of the vent through hole.

10. An electronic cigarette, comprising an atomizer, wherein the atomizer comprises a smoke channel, an atomizer head and a collecting container, an end of the smoke channel is in fluid communication with the atomizer head, the collecting container is detachably provided in the smoke channel, and the collecting container comprises a collecting cavity and an air outlet in fluid communication with two ends of the smoke channel; the collecting cavity has a closed end near the atomizer head and an open end away from the atomizer head, and the open end of the collecting cavity is in fluid communication with a channel wall of the smoke channel located above the open end of the collecting cavity.

11. The electronic cigarette according to claim 10, wherein the open end of the collecting cavity is in fluid communication with the channel wall of the smoke channel located above the open end of the collecting cavity in any one of the following manners: (1) the channel wall of the smoke channel located above the open end of the collecting cavity extends from the open end of the collecting cavity into the collecting cavity; (2) the channel wall of the smoke channel located above the open end of the collecting cavity is suspended over the open end of the collecting cavity; and (3) the channel wall of the smoke channel located above the open end of the collecting cavity is connected with a cavity wall of the collecting cavity.

12. The electronic cigarette according to claim 10, wherein the collecting container comprises a connecting portion and an enclosing portion; the enclosing portion is sheathed in the connecting portion, and the enclosing portion and the connecting portion are connected with each other at an end near the atomizer head, and are separated with each other at another end away from the atomizer head, such that an inner surface of the connecting portion and an outer surface of the enclosing portion jointly enclose a space therebetween to form the collecting cavity.

13. The electronic cigarette according to claim 12, wherein the enclosing portion is formed by an edge of the connecting portion at the end near the atomizer head extending inwardly along a radial direction of the connecting portion and then extending upwardly along an axial direction of the connecting portion, and the air outlet is defined by an inner surface of the enclosing portion, or the air outlet is defined in an inner peripheral wall of the enclosing portion.

14. The electronic cigarette according to claim 13, wherein the collecting container further comprises a blocking portion when the air outlet is defined in the inner peripheral wall of the enclosing portion; the blocking portion is provided at the end of the enclosing portion where the enclosing portion is separated from the connecting portion and isolates between above the atomizer head and another end of the smoke channel.

15. The electronic cigarette according to claim 13, wherein the atomizer further comprises a top cover and an atomizing sleeve; an end of the atomizing sleeve is sheathed outside the atomizer head, another end of the atomizing sleeve opposite to the atomizer head is detachably connected with the top cover, and two ends of the top cover is defined with a vent through hole extending through the two opposite ends thereof, the vent through hole and an inner cavity of the atomizing sleeve located between the atomizer head and the top cover are in fluid communication with each other to form the smoke channel.

16. The electronic cigarette according to claim 15, wherein the top cover comprises a body and an extending edge provided at a periphery of the body, the vent through hole is defined in the body and runs through two ends of the body positioned along its axial direction, the end of the atomizing sleeve opposite to the atomizer head is detachably connected with the extending edge, an end of the body extends into the atomizing sleeve and is detachably connected with the end of the connecting portion where the connecting portion is separated from the enclosing portion, and the vent through hole is in fluid communication with the atomizer head via the air outlet.

17. The electronic cigarette according to claim 15, wherein an inner wall of the inner cavity of the atomizing sleeve and/or an inner wall of the vent through hole forming the smoke channel is coated with a coating of a low thermal conductivity material, or the atomizing sleeve and/or the top cover is made of a low thermal conductivity material.

18. The electronic cigarette according to claim 15, wherein an inner wall of the inner cavity of the atomizing sleeve or an inner wall of the vent through hole is provided with a stream guiding plate protruding therefrom and inclined towards the collecting cavity; or the inner wall of the inner cavity of the atomizing sleeve or the inner wall of the vent through hole is provided with a stream guiding groove; or an inner wall of the connecting portion is formed with a stream guiding surface inclined towards the collecting cavity when the connecting portion is detachably connected with the inner wall of the inner cavity of the atomizing sleeve or the inner wall of the vent through hole.

* * * * *